US009625183B2

(12) United States Patent
Wallace et al.

(10) Patent No.: US 9,625,183 B2
(45) Date of Patent: Apr. 18, 2017

(54) SYSTEM AND METHOD FOR CONTROL OF A TRANSCRITICAL REFRIGERATION SYSTEM

(71) Applicant: Emerson Climate Technologies Retail Solutions, Inc., Kennesaw, GA (US)

(72) Inventors: John Wallace, Acworth, GA (US); Franklin Beltran, Acworth, GA (US); Samuele Da Ros, Milan (IT)

(73) Assignee: Emerson Climate Technologies Retail Solutions, Inc., Kennesaw, GA (US)

( * ) Notice: Subject to any disclaimer, the term of this patent is extended or adjusted under 35 U.S.C. 154(b) by 0 days.

(21) Appl. No.: 14/162,792

(22) Filed: Jan. 24, 2014

(65) Prior Publication Data

US 2014/0208785 A1 Jul. 31, 2014

Related U.S. Application Data

(60) Provisional application No. 61/756,852, filed on Jan. 25, 2013.

(51) Int. Cl.
*F25B 1/10* (2006.01)
*F25B 5/04* (2006.01)
(Continued)

(52) U.S. Cl.
CPC ..... *F25B 9/008* (2013.01); *F25B 49/02* (2013.01); *F25B 1/10* (2013.01); *F25B 5/02* (2013.01);
(Continued)

(58) Field of Classification Search
CPC ..... F25B 1/10; F25B 2309/061; F25B 9/008; F25B 24/023; F25B 2700/2106; F25B 2341/0662; F25B 2700/2109
See application file for complete search history.

(56) References Cited

U.S. PATENT DOCUMENTS 5,174,123 A * 12/1992 Erickson ..... F25B 1/047 62/113
6,161,394 A 12/2000 Alsenz
(Continued)

FOREIGN PATENT DOCUMENTS

EP 1884725 A2 2/2008
KR 20100036345 A 4/2010
(Continued)

OTHER PUBLICATIONS

NPL-Einstein-RX-Ref-Controller026-1601-Rev3,Apr. 10, 2001, p. 13-6.*
(Continued)

*Primary Examiner* — Frantz Jules
*Assistant Examiner* — Meraj A Shaikh
(74) *Attorney, Agent, or Firm* — Harness, Dickey & Pierce, P.L.C.

(57) ABSTRACT

A system and method for a $CO_2$ refrigeration system includes a compressor, a heat exchanger, a liquid receiver, a first valve, and a valve controller. The heat exchanger operates as a gas cooler when the $CO_2$ refrigeration system is in a transcritical mode and as a condenser when the $CO_2$ refrigeration system is in the subcritical mode. The first valve controls a flow of refrigerant from the heat exchanger to the liquid receiver. The valve controller monitors an outdoor ambient temperature and a pressure of refrigerant exiting the heat exchanger, determines whether the $CO_2$ refrigeration system is in the subcritical mode or in the transcritical mode, determines a pressure setpoint based on the monitored outdoor ambient temperature, and controls the first valve based on a comparison of the determined pressure setpoint and the monitored pressure when the $CO_2$ refrigeration system is in the transcritical mode.

18 Claims, 6 Drawing Sheets

(51) Int. Cl.

| | |
|---|---|
| ***F25B 1/047*** | (2006.01) |
| ***F25B 6/04*** | (2006.01) |
| ***F25B 9/00*** | (2006.01) |
| ***F25B 49/02*** | (2006.01) |
| *F25B 5/02* | (2006.01) |

(52) U.S. Cl.
CPC ..... *F25B 2309/06* (2013.01); *F25B 2309/061* (2013.01); *F25B 2400/075* (2013.01); *F25B 2400/23* (2013.01); *F25B 2600/2503* (2013.01); *F25B 2600/2509* (2013.01); *F25B 2700/19* (2013.01); *F25B 2700/2102* (2013.01); *F25B 2700/2108* (2013.01)

(56) References Cited

U.S. PATENT DOCUMENTS

| | | | | |
|---|---|---|---|---|
| 6,192,696 | B1 * | 2/2001 | Shimamoto | C09K 5/045 62/209 |
| 6,385,980 | B1 * | 5/2002 | Sienel | F25B 5/04 62/174 |
| 7,290,398 | B2 | 11/2007 | Wallace et al. | |
| 7,451,617 | B2 | 11/2008 | Renz et al. | |
| 9,360,237 | B2 | 6/2016 | Huff | |
| 2003/0159458 | A1 * | 8/2003 | Fang | F25B 6/04 62/305 |
| 2005/0178153 | A1 * | 8/2005 | Guillard | F25J 3/04018 62/643 |
| 2008/0022706 | A1 * | 1/2008 | Sakimichi | F25B 1/10 62/190 |
| 2008/0223051 | A1 * | 9/2008 | Kates | F24F 3/1603 62/129 |
| 2008/0307805 | A1 * | 12/2008 | Gupte | F25B 1/10 62/117 |
| 2010/0115975 | A1 | 5/2010 | Mitra et al. | |
| 2010/0175400 | A1 | 7/2010 | Kasahara | |
| 2011/0023514 | A1 * | 2/2011 | Mitra | F25B 1/10 62/222 |
| 2011/0138825 | A1 * | 6/2011 | Chen | F25B 1/10 62/115 |
| 2011/0146313 | A1 * | 6/2011 | Finckh | F25B 9/008 62/186 |
| 2012/0227427 | A1 * | 9/2012 | Liu | F25B 1/10 62/115 |
| 2012/0318006 | A1 | 12/2012 | Liu et al. | |
| 2014/0053585 | A1 | 2/2014 | Huff | |
| 2014/0116075 | A1 | 5/2014 | Prins | |

FOREIGN PATENT DOCUMENTS

| | | | |
|---|---|---|---|
| WO | WO-2010003590 | A2 | 1/2010 |
| WO | WO 2011/049778 | * | 4/2011 |
| WO | WO-2011112495 | A2 | 9/2011 |
| WO | 2012145156 | A1 | 10/2012 |
| WO | 2013004233 | A1 | 1/2013 |
| WO | 2014116915 | A1 | 7/2014 |

OTHER PUBLICATIONS

"Controllers for Multiplexed Cabinets With stepper Driver Inside XM678D Instlling and Operating Instructions," Dixell S.r.l., dated Jul. 5, 2011 (14 pages).
"E2 Installation and Operation Manual for RX Refrigeration, BX HVAC, and CX Colnvenience Store Controllers," Emerson Climate Technologies, Apr. 25, 2011 (263 pages).
"Einstein BX Building Controller User's Guide, 026-1602 Rev 3," Computer Process Controls, Inc., Apr. 11, 2001 (208 pages).
"Einstein RX Refrigeration Controller User's Guide, 026-1601 Rev 3," Computer Process Controls, Inc., Apr. 10, 2001 (229 pages).
"Electronic Controller for Compressor Racks XC1008D XC1011D-XC1015D and VGC810 Instructions Manual," Dixell S.p.A., Jun. 4, 2007 (60 pages).
"Electronic Controller for Compressor Racks XC440C-XC440D Instructions Manual," Dixell S.p.a., Jul. 6, 2005 (27 pages).
"Electronic Controller for Compressor Racks XC460D Instructions Manual," Dixell S.p.A., Jul. 5, 2004 (26 pages).
"Electronic Controller for Compressor Racks XC640C Instructions Manual," Dixell S.p.A., dated Jun. 7, 2004 (30 pages).
"Electronic Controller for Compressor Racks XC650C Instructions Manual," Dixell S.p.a., Jul. 6, 2012 (32 pages).
"Electronic Controller for Compressor Racks XC706M Instructions Manual," Dixell s.r.l., Feb. 28, 2003 (28 pages).
"Electronic Controller for Compressor Racks XC807M-XC811M-XC907M-XC911M Instructions Manual," Dixell s.r.l., Feb. 28, 2003 (36 pages).
"iCHiLL XC200L Series User Manual," Dixell S.p.A., Jan. 9, 2008 (46 pages).
"iPro HVAC and lighting controller," Emerson Climate Technologies, 2011 (2 pages).
"iPro HVAC and Lighting Installation and Operation Manual," Emerson Climate Technologies, Aug. 25, 2011 (53 pages).
"XC645CX (v. 1.0) Installing and Operating Instructions," Dixel S.r.l., Jan. 31, 2011 (40 pages).
International Search Report regarding Application No. PCT/US2014/012892, mailed May 1, 2014.
Written Opinion of the International Searching Authority regarding Application No. PCT/US2014/012892, mailed May 1, 2014.
Office Action regarding Australian Patent Application No. 2014209299, dated Mar. 16, 2016.
Search Report regarding European Patent Application No. 14743925.1, dated Aug. 30, 2016.
Office Action regarding Canadian Patent Application No. 2,899,277, dated Apr. 22, 2016.

* cited by examiner

SYSTEM AND METHOD FOR CONTROL OF A TRANSCRITICAL REFRIGERATION SYSTEM

CROSS-REFERENCE TO RELATED APPLICATIONS

This application claims the benefit of U.S. Provisional Application No. 61/756,852, filed on Jan. 25, 2013. The entire disclosure of the above application is incorporated herein by reference.

FIELD

The present disclosure relates to a system and method for control of a transcritical refrigeration system and, more specifically, to a system and method for controlling components of a transcritical refrigeration system utilizing $CO_2$ refrigerant and including a high pressure valve, a bypass gas valve, and a liquid receiver.

BACKGROUND

This section provides background information related to the present disclosure which is not necessarily prior art.

Refrigeration systems utilizing carbon dioxide ($CO_2$) as a refrigerant can have many advantages over refrigeration systems utilizing non-$CO_2$ refrigerants. Refrigeration systems utilizing $CO_2$ refrigerant may include, for example, one or more compressors, a gas cooler, a liquid receiver, and one or more evaporators. The liquid receiver may include a bypass line to discharge refrigerant from the liquid receiver back to the compressors, thereby bypassing the evaporators.

In a refrigeration system utilizing non-$CO_2$ refrigerant, the compressors discharge high pressure gaseous refrigerant to a condenser which cools the refrigerant to below its critical point, resulting in a change in state of the refrigerant from gas to liquid.

In a $CO_2$ refrigeration system operating in a transcritical mode, on the other hand, the gaseous refrigerant is cooled in a gas cooler to a temperature that is still above the critical point of the refrigerant, resulting in a cooler gaseous refrigerant but not resulting in a change in state to liquid. The $CO_2$ refrigerant is then discharged from the gas cooler to a liquid receiver connected to the evaporators and also connected to a bypass line. The pressure of the liquid receiver can be maintained to allow liquid refrigerant to form in the liquid receiver. Liquid refrigerant can then be supplied from the liquid receiver to the evaporators. Gaseous refrigerant in the liquid receiver can then be routed back to the compressors.

Because of the higher operating temperatures and pressures associated with $CO_2$ refrigeration systems, maintaining proper and efficient operation of the refrigeration system can be difficult.

SUMMARY

This section provides a general summary of the disclosure, and is not a comprehensive disclosure of its full scope or all of its features.

In various embodiments of the present disclosure, a $CO_2$ refrigeration system that is operable in a subcritical mode and a transcritical mode is provided. The $CO_2$ refrigeration system includes at least one compressor and a heat exchanger that receives refrigerant discharged from the at least one compressor. The heat exchanger is operable as a gas cooler when the $CO_2$ refrigeration system is operating in the transcritical mode and as a condenser when the $CO_2$ refrigeration system is operating in the subcritical mode. The $CO_2$ refrigeration system also includes a liquid receiver that receives refrigerant discharged from the heat exchanger. The $CO_2$ refrigeration system also includes a first valve connected between the heat exchanger and the liquid receiver. The first valve controls a flow of refrigerant from the heat exchanger to the liquid receiver. The $CO_2$ refrigeration system also includes a valve controller that monitors an outdoor ambient temperature and a pressure of refrigerant exiting the heat exchanger. The valve controller determines whether the $CO_2$ refrigeration system is operating in the subcritical mode or in the transcritical mode and determines a pressure setpoint based on the monitored outdoor ambient temperature. The valve controller controls the first valve based on a comparison of the determined pressure setpoint and the monitored pressure of refrigerant exiting the heat exchanger when the $CO_2$ refrigeration system is determined to be operating in the transcritical mode.

In various embodiments of the present disclosure, a method for a $CO_2$ refrigeration system operable in a subcritical mode and a transcritical mode is provided. The method includes monitoring, with a valve controller, an outdoor ambient temperature. The method also includes monitoring, with the valve controller, a pressure of refrigerant exiting a heat exchanger of the $CO_2$ refrigeration system. The heat exchanger receives refrigerant discharged from at least one compressor and is operable as a gas cooler when the $CO_2$ refrigeration system is operating in the transcritical mode and as a condenser when the $CO_2$ refrigeration system is operating in the subcritical mode. The method also includes determining, with the valve controller, whether the $CO_2$ refrigeration system is operating in the subcritical mode or in the transcritical mode. The method also includes determining, with the valve controller, a pressure setpoint based on the monitored outdoor ambient temperature. The method also includes controlling, with the valve controller, a first valve based on a comparison of the determined pressure setpoint and the monitored pressure of refrigerant exiting the heat exchanger when the $CO_2$ refrigeration system is determined to be operating in the transcritical mode. The first valve is connected between the heat exchanger and a liquid receiver and controlling a flow of refrigerant from the heat exchanger to the liquid receiver.

In various embodiments of the present disclosure, another $CO_2$ refrigeration system, operable in a subcritical mode and a transcritical mode, is provided. The $CO_2$ refrigeration system includes a first compressor rack and a second compressor rack, each having at least one compressor. The first compressor rack and the second compressor rack are connected such that a suction side of the second compressor rack receives refrigerant from a discharge side of the first compressor rack. The $CO_2$ refrigeration system includes a heat exchanger operable as a gas cooler when the $CO_2$ refrigeration system is operating in a transcritical mode and as a condenser when the $CO_2$ refrigeration system is operating in a subcritical mode. The heat exchanger receives refrigerant from a discharge side of the second compressor rack. The $CO_2$ refrigeration system includes a liquid receiver that receives refrigerant discharged from the heat exchanger. The $CO_2$ refrigeration system includes at least one evaporator that receives refrigerant discharged from the liquid receiver. The $CO_2$ refrigeration system includes a first valve connected between the heat exchanger and the liquid receiver. The first valve controls a flow of refrigerant from the heat exchanger to the liquid receiver. The $CO_2$ refrigeration system includes a second valve located in a bypass line that routes refrigerant from the liquid receiver to the suction side of the second compressor rack. The second valve controls a flow of refrigerant from the liquid receiver to the suction side of the second compressor rack. The $CO_2$ refrigeration system includes a valve controller that monitors a pressure of refrigerant exiting the heat exchanger, a temperature of refrigerant exiting the heat exchanger, and a pressure within the liquid receiver. The valve controller controls the first valve and the second valve based on at least one of the monitored pressure of refrigerant exiting the heat exchanger, the monitored temperature of refrigerant exiting the heat exchanger, and the monitored pressure within the liquid receiver.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
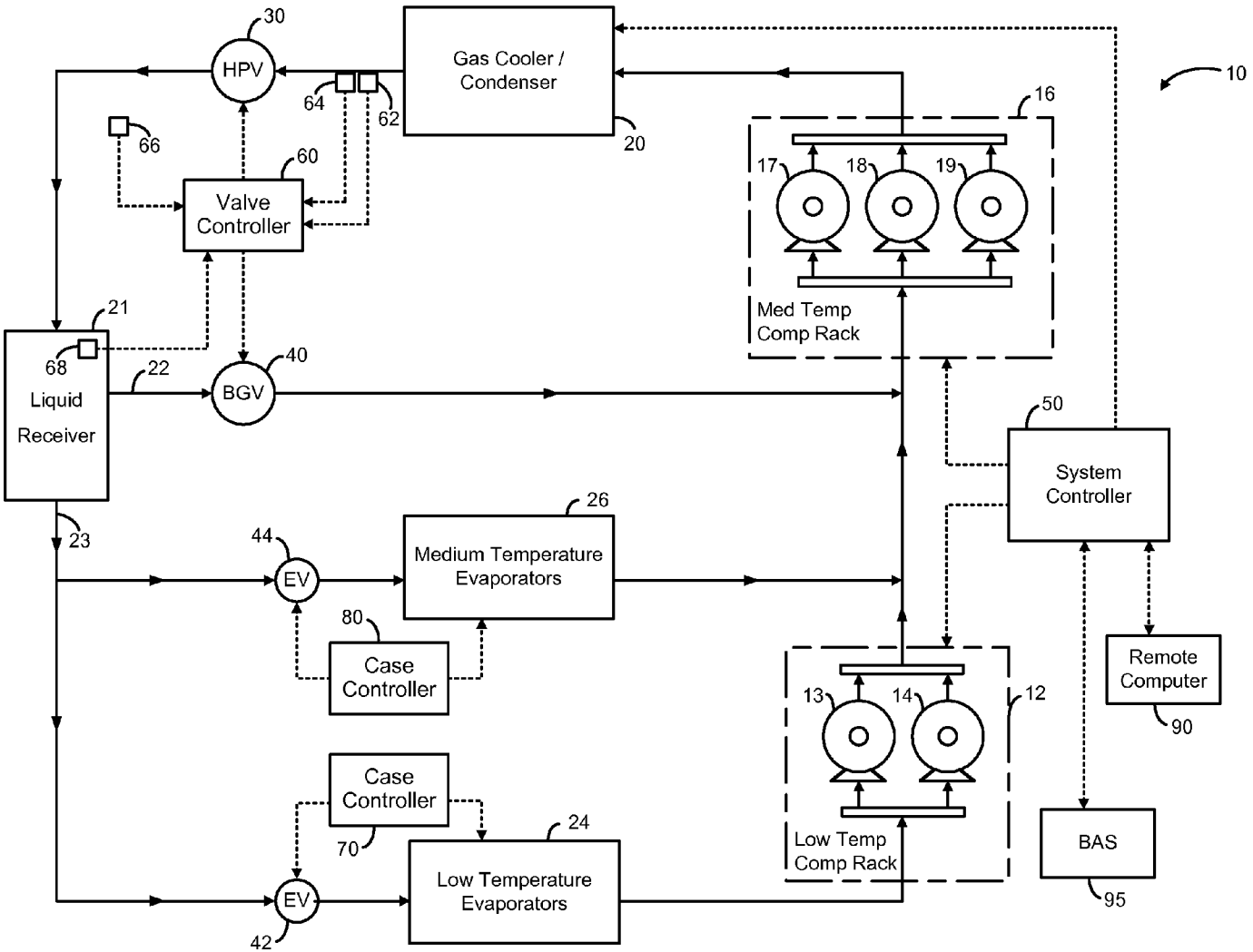
FIG. 1 is a schematic of a $CO_2$ refrigeration system.

With reference to FIG. 1, a booster transcritical $CO_2$ refrigeration system 10 includes a low temperature compressor rack 12 with compressors 13, 14, and a medium temperature compressor rack 16 with compressors 17, 18, 19. The compressors 13, 14, 17, 18, 19 may be fixed capacity or variable capacity compressors. For example, each compressor rack 12, 16 may include at least one variable capacity compressor and at least one fixed capacity compressor. The compressors in each rack may be connected via appropriate suction and discharge headers. The low temperature compressor rack 12 may be connected in series with the medium temperature compressor rack 16 such that the refrigerant discharged from the low temperature compressor rack 12 is received on a suction side of the medium temperature compressor rack 16.

Refrigerant discharged from the medium temperature compressor rack 16 is received by a gas cooler/condenser 20. As described in further detail below, the refrigeration system 10 may be operable in a subcritical mode or in a transcritical mode. In the transcritical mode, the gas cooler/condenser 20 functions as a gas cooler. In the subcritical mode, the gas cooler/condenser 20 functions as a condenser.

Refrigerant discharged from the gas cooler/condenser 20 is received by liquid receiver 21. Liquid receiver 21 is connected to a first discharge line 22 that routes gaseous refrigerant from the liquid receiver 21 back to the suction side of the medium temperature compressor rack 16. The liquid receiver 21 is also connected to a second discharge line 23 that routes liquid refrigerant from the liquid receiver 21 to evaporators 24, 26.

Refrigerant routed from the liquid receiver 21 via the second discharge line 23 is received by the low temperature evaporators 24 and the medium temperature evaporators 26. The low temperature evaporators 24 may include, for example, grocery store freezers or frozen food cases. The medium temperature evaporators 26 may include, for example, dairy or meat cases.

Refrigerant from the low temperature evaporator 24 is then discharged to the suction side of the low temperature compressor rack 12. Refrigerant from the medium temperature evaporators 26 is then discharged to the suction side of the medium temperature compressor rack 16. The refrigeration cycle then starts anew.

The refrigeration system 10 may include various valves, controlled by various associated controllers, to monitor and regulate the various temperatures and pressures within the refrigeration system 10 to maintain efficient and desirable operation.

Specifically, refrigeration system 10 includes a high pressure valve (HPV) 30 and a bypass gas valve (BGV) 40. As shown in FIG. 1, the HPV 30 is located between the gas cooler/condenser 20 and the liquid receiver 21. The BGV 40 is located on the first discharge line 22 between the liquid receiver 21 and the suction side of the medium temperature compressor rack 16. As described in further detail below, HPV 30 and BGV 40 are adjusted and controlled to maintain certain system operating conditions for efficient and desirable operation. For example, the HPV 30 controls the flow of refrigerant from the gas cooler/condenser 20 to the liquid receiver 21. The BGV 40 controls the flow of refrigerant from the liquid receiver 21 to the suction side of the medium temperature compressor rack 16. The HPV 30 and the BGV 40 may include, for example, associated stepper motors for variable adjustment of the valve openings.

The low temperature evaporators 24 and the medium temperature evaporators 26 each include an associated expansion valve (EV) 42, 44.

The refrigeration system 10 includes various controllers that monitor operating and environmental conditions, including temperature and pressures, and control the various system components according to programmed control strategies. Specifically, a system controller 50 controls the compressor racks 12, 16 by activating, deactivating, and adjusting the compressors 13, 14, 17, 18, 19, of the compressor racks 12, 16. The system controller 50 also controls the gas cooler/condenser 20 by activating, deactivating, and adjusting fans of the gas cooler/condenser 20. The system controller 50 may be, for example, an Einstein RX Refrigeration Controller, an Einstein BX Building/HVAC Controller, an E2 RX Refrigeration Controller, an E2 BX HVAC Controller, or an E2 CX Convenience Store Controller, available from Emerson Climate Technologies Retail Solutions, Inc., of Kennesaw, Ga., or a compressor rack controller, such as the XC series controller, available from Dixell S.p.A., of Pieve d'Alpago (Belluno), Italy, with appropriate programming in accordance with the present disclosure. The system controller 50 may include a user interface, such as a touchscreen or a display screen and user input device, such as a keyboard, to communicate with a user. For example, the system controller 50 may output system parameters, such as system operating temperatures or pressures, and/or system setpoints to a user. Further, the system controller 50 may receive user input modifying the system setpoints or control algorithms.

The refrigeration system 10 includes a valve controller 60 programmed to control the HPV 30 and the BGV 40. The valve controller 60 is connected to various temperature and pressure sensors to monitor system and environmental conditions. Specifically, the valve controller 60 is connected to a refrigerant temperature sensor 62 that senses a temperature of refrigerant exiting the gas cooler/condenser 20. The valve controller 60 is also connected to a refrigerant pressure sensor 64 that senses a pressure of refrigerant exiting the gas cooler/condenser 20. While separate pressure and temperature sensors are shown in FIG. 1, alternatively a single combination refrigerant pressure and temperature sensor could be used to sense both the pressure and temperature of refrigerant exiting the gas cooler/condenser 20. The valve controller 60 is also connected to an outdoor ambient temperature (OAT) sensor 66 that senses an outdoor ambient temperature. Alternatively, sensor 66 may sense other system or operating conditions, such as other system operating temperatures or pressures, including the temperature or pressure of refrigerant at a designated location in the refrigeration cycle. The valve controller 60 is also connected to a liquid receiver pressure sensor 68 that senses a pressure of refrigerant within the liquid receiver 21. As discussed in further detail below, the valve controller 60 controls the openings of the HPV 30 and BGV 40 to maintain efficient and desirable operation of the refrigeration system 10 in both subcritical and transcritical modes.

The valve controller 60 may be an iPro Controller, available from Emerson Climate Technologies Retail Solutions, Inc., of Kennesaw, Ga., with appropriate programming in accordance with the present disclosure for controlling the HPV 30 and BGV 40. Further, the valve controller 60 may include a user interface, such as a touchscreen or a display screen and user input device, such as a keyboard, to communicate with a user. For example, the valve controller 60 may output system parameters, such as system operating temperatures or pressures, and/or system setpoints to a user. Further, the valve controller 60 may receive user input modifying the system setpoints or control algorithms.

The refrigeration system 10 also includes case controllers 70, 80 for controlling the low temperature evaporators 24 and medium temperature evaporators 26 and the associated expansion valves 42, 44. For example, the case controllers 70, 80 may activate, deactivate, and adjust the evaporator fans of the evaporators 24, 26. The case controllers may also adjust the expansion valves 42, 44. The case controllers 70, 80 may be XM678 Case Controllers, available from Dixell S.p.A., of Pieve d'Alpago (Belluno), Italy, with appropriate programming in accordance with the present disclosure. Further, the case controllers 70, 80 may include a user interface, such as a touchscreen or a display screen and user input device, such as a keyboard, to communicate with a user. For example, the case controllers 70, 80 may output system parameters, such as system operating temperatures or pressures, and/or system setpoints to a user. Further, the case controllers 70, 80 may receive user input modifying the system setpoints or control algorithms.

Each of the controllers shown in FIG. 1 is operable to communicate with each other. For example, the system controller 50 may adjust operation or setpoints of the valve controller 60 and the case controllers 70, 80. Further, if a local sensor of the valve controller 60 fails, it may communicate with the system controller 50 or the case controllers 70, 80 to adjust operation accordingly. For example, if the local OAT sensor 66 of the valve controller 66 fails, it may communicate with the system controller 50 or the case controllers 70, 80 to receive OAT data from an OAT sensor connected or accessible to the system controller 50 or the case controllers 70, 80.

Additionally, a remote computer 90 may be connected to the system controller 50 so that a remote user can log into the system controller 50 and monitor, control, or adjust operation of any of the controllers, including the system controller 50, the valve controller 60, and the case controllers 70, 80.

Additionally, the system controller 50 may be in communication with a building automation system (BAS) 95. The BAS 95 may be connected to additional temperature and pressure sensors and may monitor and store additional temperature and pressure data that can be accessed by the system controller 50, and/or the valve controller 60, in the event of a sensor failure. The remote computer 90 can also be connected to the BAS 95 so that a remote user can log into the BAS 95 and monitor, control, or adjust operation of any of the controllers, including the system controller 50, the valve controller 60, and the case controllers 70, 80.

Figure 2:
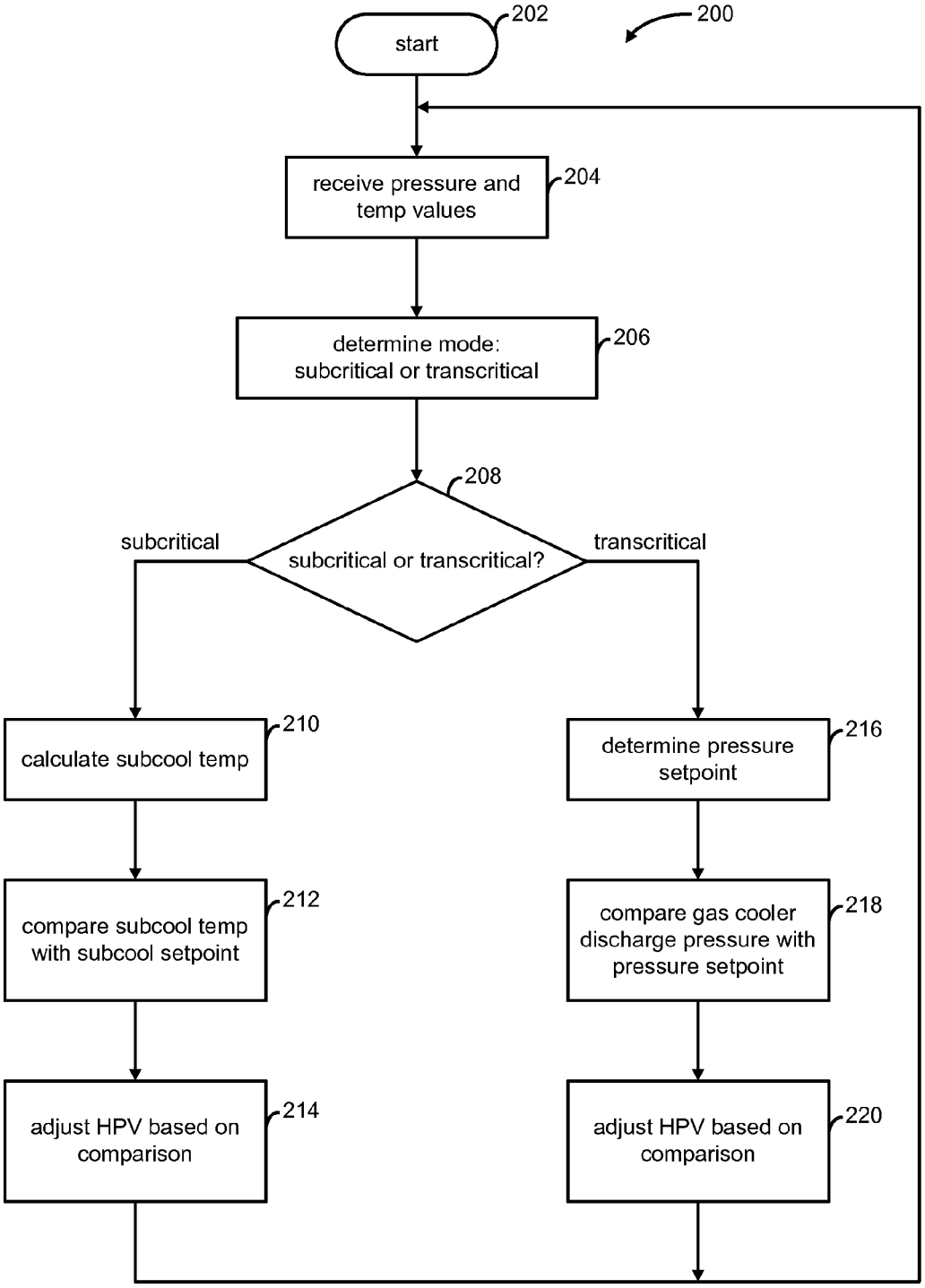
FIG. 2 is a flowchart for a control algorithm for a $CO_2$ refrigeration system.

With reference to FIG. 2, a control algorithm 200 is shown for adjusting the HPV 30. The control algorithm 200 may be performed by valve controller 60. Alternatively, the control algorithm 200 may be performed by system controller 50, which may output appropriate control signals to valve controller 60 or directly to the HPV 30. The control algorithm 200 starts at 202. At 204, the valve controller 60 receives pressure and temperature values from the connected pressure and temperature sensors 62, 64, 66, 68. Specifically, the valve controller 60 receives data indicating the pressure and temperature of refrigerant exiting the gas cooler/condenser 20, the OAT, and the pressure within the liquid receiver 21.

At 206, the valve controller 60 determines whether the refrigeration system 10 is operating in a subcritical or a transcritical mode. For example, valve controller 60 may compare a current system or operating condition with a particular system or operating condition setpoint. As an example, valve controller 60 may compare the current OAT with an OAT setpoint to determine whether the refrigeration system 10 is in subcritical or transcritical mode. When the OAT is above the OAT setpoint, the valve controller 60 may determine that the refrigeration system 10 is in transcritical mode. When the OAT is below the OAT setpoint, the valve controller 60 may determine that the refrigeration system 10 is in subcritical mode. For example, the OAT setpoint may be 14 degrees Celsius. As another example, the valve controller 60 may compare the current OAT with an OAT setpoint minus a predetermined OAT hysteresis value. In such case, for example, the OAT setpoint may be 21 degrees Celsius and the OAT hysteresis value may be 7 degrees Celsius. Both the OAT setpoint and the OAT hysteresis value may be user configurable. Alternatively, the valve controller 60 may make the determination by comparing the current temperature and/or pressure of refrigerant exiting the gas cooler/condenser 20 with a temperature or pressure setpoint. Alternatively, the valve controller 60 may evaluate the OAT in combination with the pressure and/or temperature of refrigerant exiting the gas cooler/condenser 20 to make the determination as to whether the refrigeration system 10 is operating in a subcritical mode or a transcritical mode.

At 208, when the refrigeration system 10 is in subcritical mode, the valve controller 60 proceeds to 210. At 210, the valve controller 60 calculates a current subcooling temperature based on the temperature and pressure of refrigerant exiting the gas cooler/condenser 20. Specifically, based on the temperature and pressure of refrigerant exiting the gas cooler/condenser 20, the valve controller 60 can determine the critical point of the refrigerant. The valve controller 60 may then compare the critical point of the refrigerant with the current temperature of the refrigerant exiting the gas cooler/condenser 20. The valve controller 60 may determine the subcooling temperature value to be the difference between the critical point of the refrigerant and the current temperature of the refrigerant exiting the gas cooler/condenser 20.

At 212, the valve controller 60 compares the subcooling temperature with a subcooling temperature setpoint and determines a difference between the two values. For example, the subcooling temperature setpoint may be 10 degrees Celsius.

At 214, the valve controller 60 adjusts the HPV 30 based on the comparison. Specifically, the valve controller 60 adjusts the HPV 30 to drive the current subcooling temperature value toward the subcooling temperature setpoint. The valve controller 60 may use a PID control algorithm, a PI control algorithm, fuzzy logic, or a neural network type control system/algorithm to make appropriate adjustments to the HPV 30. After adjusting the HPV 30, the valve controller loops back to 204.

At 208, when the refrigeration system 10 is in transcritical mode, the valve controller 60 proceeds to 216. At 216, the valve controller 60 determines a pressure setpoint. For example, the valve controller 60 may reference a lookup table that includes pressure setpoints indexed based on a system or environmental operating condition. For example, the lookup table may include pressure setpoints indexed based on OAT. As such, valve controller 60 may determine the current OAT and may access the lookup table to determine the corresponding pressure setpoint. If the current OAT is between table entries, the valve controller 60 may interpolate a pressure setpoint based on the nearest table entries. The lookup table may be stored in a memory included in, or accessible to, the valve controller 60. For example, the lookup table may be stored at the system controller 50 and the valve controller 60 may query the system controller 50 to obtain the pressure setpoint. Alternatively, the lookup table may include pressure setpoints indexed based on a temperature or pressure of refrigerant exiting the gas cooler/condenser 20, or another system or environmental operating temperature or pressure.

An example lookup table, showing ambient temperatures with corresponding pressure setpoints is shown in Table 1 below.

TABLE 1

| Ambient Temperature (C.) | Pressure Setpoint (Bar) |
|---|---|
| −3 | 39.2 |
| −2 | 40.2 |
| −1 | 41.2 |
| 0 | 42.3 |
| 1 | 43.3 |
| 2 | 44.4 |
| 3 | 45.5 |
| 4 | 46.7 |
| 5 | 47.8 |
| 6 | 49 |
| 7 | 50.2 |
| 8 | 51.4 |
| 9 | 52.7 |
| 10 | 53.9 |

TABLE 1-continued

| Ambient Temperature (C.) | Pressure Setpoint (Bar) |
|---|---|
| 11 | 55.2 |
| 12 | 56.5 |
| 13 | 57.9 |
| 14 | 59.2 |
| 15 | 60.6 |
| 16 | 62.1 |
| 17 | 63.5 |
| 18 | 65 |
| 19 | 66.5 |
| 20 | 68 |
| 21 | 75 |
| 22 | 75 |
| 23 | 75 |
| 24 | 75 |
| 25 | 75 |
| 26 | 75 |
| 27 | 75 |
| 28 | 77.5 |
| 29 | 80 |
| 30 | 82.5 |
| 31 | 85 |
| 32 | 87.5 |
| 33 | 90 |
| 34 | 92.5 |
| 35 | 95 |
| 36 | 97.5 |
| 37 | 99.5 |
| 38 | 102 |
| 39 | 104.5 |
| 40 | 106.5 |
| 41 | 109 |
| 42 | 111 |

The lookup table may be specific to, and optimized for, a particular model, size, or type of compressor(s) or other system component(s). For example, the system controller 50 may query the individual compressors 13, 14, 17, 18, 19 in the compressor racks 12, 16 or the system controller 50 to identify the compressors present in the refrigeration system 10 and may determine the most appropriate lookup table, or may generate an installation specific lookup table, based on the identified compressors included in the refrigeration system 10. For example, each compressor 13, 14, 17, 18, 19 may include an individual compressor controller and/or a non-volatile memory with sufficient identification information identifying the model, size, or type of compressor. The identification information may be utilized to determine the most appropriate lookup table. Specific lookup tables may be generated beforehand based on field data or experimental data, and/or based on modeled data corresponding to operation of individual compressor models, sizes, types, etc. Further, models for specific compressors may be generated based on field data and/or experimental data, and then interpolated to other similar compressors.

Alternatively, valve controller 60 may calculate the pressure setpoint as a function of the OAT. Alternatively, valve controller 60 may determine the pressure setpoint based on other system or environmental data, such as the temperature or pressure of the refrigerant exiting the gas cooler/condenser 20.

At 218, the valve controller 60 compares the pressure of refrigerant exiting the gas cooler/condenser 20 with the determined pressure setpoint. At 220, the valve controller 60 then controls the HPV 30 based on the comparison. Specifically, the valve controller 60 adjusts the HPV 30 to drive the current pressure value toward the determined pressure setpoint. The valve controller 60 may use a PID control algorithm, a PI control algorithm, fuzzy logic, or a neural network type control system/algorithm to make appropriate adjustments to the HPV 30. After adjusting the HPV 30, the valve controller loops back to 204.

Figure 3:
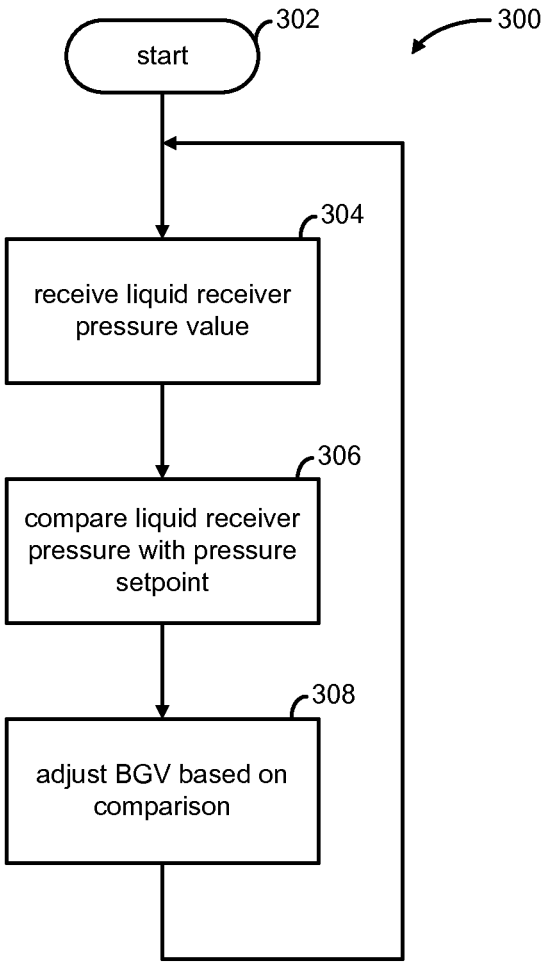
FIG. 3 is a flowchart for a control algorithm for a $CO_2$ refrigeration system.

With reference to FIG. 3, a control algorithm 300 is shown for adjusting the BGV 40. The control algorithm 300 may be performed by valve controller 60. Alternatively, the control algorithm 300 may be performed by system controller 50, which may output appropriate control signals to valve controller 60 or directly to the BGV 40. The control algorithm 300 starts at 302. At 304, the valve controller 60 receives the liquid receiver pressure value from the liquid receiver pressure sensor 68.

At 306, the valve controller compares the liquid receiver pressure with a predetermined liquid receiver pressure setpoint. For example, the predetermined liquid receiver pressure setpoint may be 15 Bar. The liquid receiver pressure setpoint may be user configurable. At 308, the valve controller adjusts the BGV 40 based on the comparison. Specifically, the valve controller 60 adjusts the BGV 40 to drive the current liquid receiver pressure value toward the predetermined liquid receiver pressure setpoint. The valve controller 60 may use a PID control algorithm, a PI control algorithm, fuzzy logic, or a neural network type control system/algorithm to make appropriate adjustments to the BGV 40. After adjusting the BGV 40, the valve controller loops back to 304.

The predetermined setpoints described above, along with all of the setpoints referenced herein, may be stored in a computer-readable medium or memory included in, or accessible to, the valve controller 60. The setpoints may be stored locally at the valve controller 60. Alternatively, the setpoints may be stored at the system controller 50 and communicated to the valve controller 60. The setpoints may be user configurable via input received directly from a user at the valve controller 60, at the system controller 50, or through the remote computer 90 and/or the BAS 95.

Figure 4:
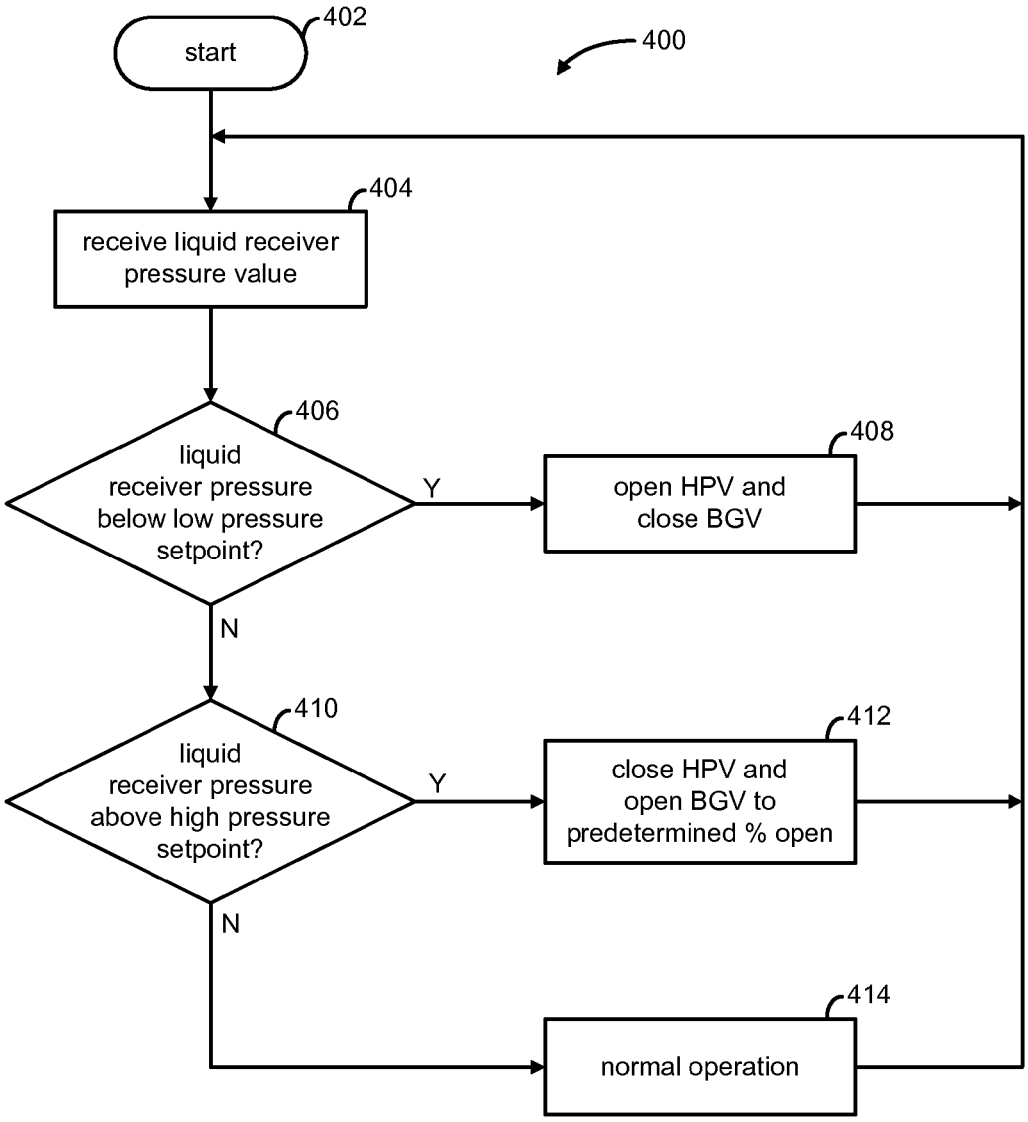
FIG. 4 is a flowchart for a control algorithm for a $CO_2$ refrigeration system.

With reference to FIG. 4, a safety control algorithm 400 is shown for adjusting the HPV 30 and the BGV 40. The safety control algorithm 400 may be performed by valve controller 60. Alternatively, the control algorithm 400 may be performed by system controller 50, which may output appropriate control signals to valve controller 60 or directly to the HPV 30 and the BGV 40. The control algorithm 400 starts at 402. At 404, the valve controller 60 receives data indicating the liquid receiver pressure from the liquid receiver pressure sensor 68.

At 406, the valve controller 60 determines whether the liquid receiver pressure is less than a low pressure setpoint. For example, the low pressure setpoint may be 1 Bar. When the liquid receiver pressure is less than the low pressure setpoint, the valve controller 60 proceeds to 408. At 408, the valve controller 60 opens the HPV 30 and closes the BGV 40. In this way, pressure in the liquid receiver will increase. The valve controller 60 then loops back to 404. Alternatively, the valve controller 60 may monitor the liquid receiver pressure until it rises above the low pressure setpoint plus a predetermined low pressure hysteresis value. For example, if the low pressure setpoint is 1 Bar, the low pressure hysteresis value may be 1 Bar. Both the low pressure setpoint and the low pressure hysteresis value may be user configurable.

At 406, when the liquid receiver pressure is not less than the low pressure setpoint, the valve controller 60 proceeds to 410. At 410, the valve controller 60 compares the liquid receiver pressure with a high pressure setpoint. For example, the high pressure setpoint may be 50 Bar. When the liquid receiver pressure is greater than the high pressure setpoint, the valve controller 60 closes the HPV 30 and opens the BGV 40 to a predetermined percent open. For example, the predetermined percent open may be eighty percent, ninety percent, or one-hundred percent. The valve controller 60 then loops back to 404. Alternatively, the valve controller 60 may monitor the liquid receiver pressure until the liquid receiver pressure is below the high pressure setpoint minus a predetermined high pressure hysteresis value. For example, if the high pressure setpoint is 50 Bar, the high pressure hysteresis value may be 5 Bar. Both the high pressure setpoint and the high pressure hysteresis value may be user configurable.

At 410, when the liquid receiver pressure is not greater than the high pressure setpoint, the valve controller 60 proceeds with normal operation at 414 and loops back to 404. Normal operation of the refrigeration system 10 may include, for example, control of the HPV 30 and BGV 40 according to the control algorithms described above with reference to FIGS. 2 and 3.

Figure 5:
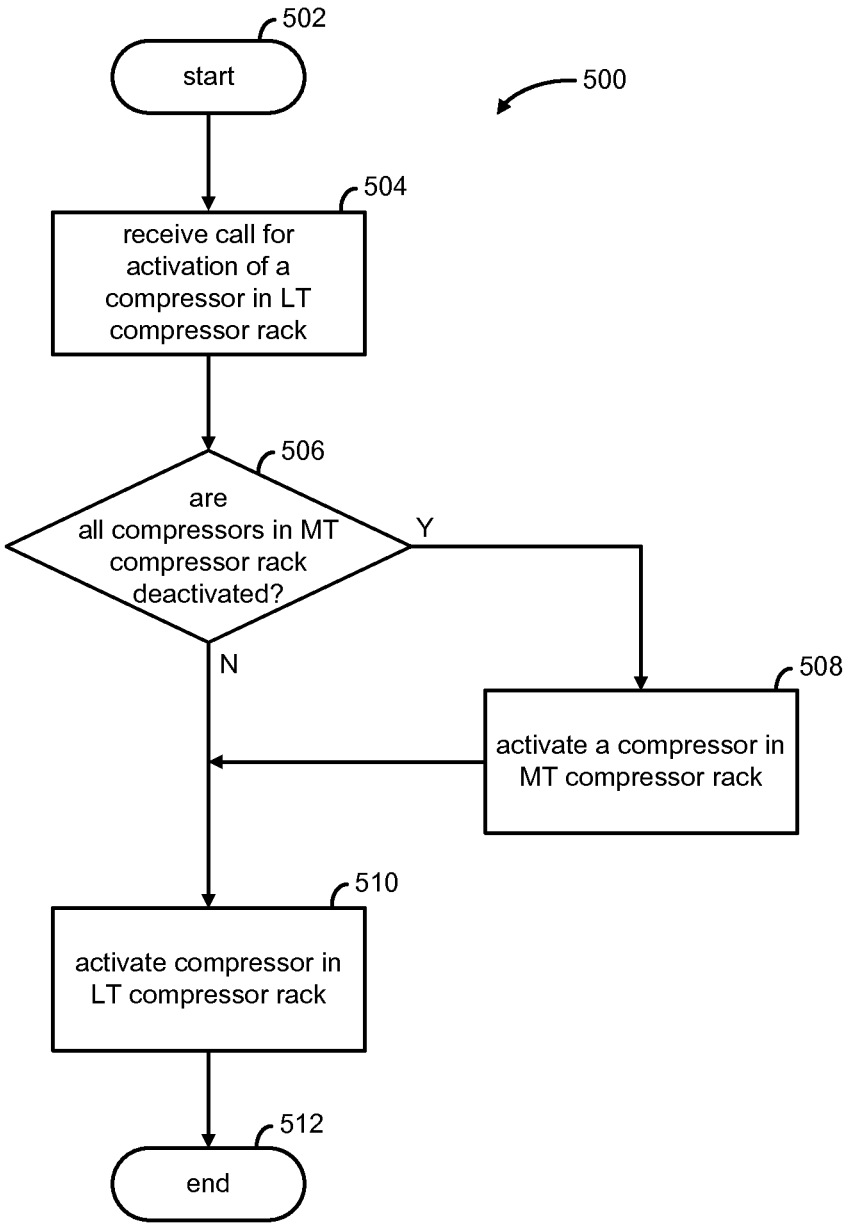
FIG. 5 is a flowchart for a control algorithm for a $CO_2$ refrigeration system.

With reference to FIG. 5, a control algorithm 500 is shown for coordinating activation of compressors in the medium temperature compressor rack 16 and the low temperature compressor rack 12. Specifically, because of the in-series manner of connection between the low temperature compressor rack 12 and the medium temperature compressor rack 16, the compressors 13, 14 in the low temperature compressor rack 12 cannot be activated unless a compressor 17, 18, 19, in the medium temperature compressor rack 16 is already activated. The control algorithm 500 is performed by the system controller 50. The control algorithm 500 starts at 502.

At 504, the system controller 50 receives or generates a call for activation of a compressor in the low temperature compressor rack 12. For example, the call for activation of a compressor in the low temperature compressor rack 12 may be received or generated when additional cooling capacity is needed for the low temperature evaporators 24. For example, the case controller 70 for the low temperature evaporators 24 may monitor the temperature of a refrigerated space, such as the interior of a frozen food case, and determine that additional cooling capacity is needed when the temperature rises above a predetermined setpoint. At 506, the system controller 50 determines whether all of the compressors 17, 18, 19 in the medium temperature compressor rack 16 are deactivated. At 506, when all of the compressors 17, 18, 19 in the medium temperature compressor rack 16 are deactivated, the system controller 50 proceeds to 508 and activates at least one compressor in the medium temperature compressor rack 16. For example, the system controller 50 may activate a fixed capacity compressor in the medium temperature compressor rack 16. Alternatively, the system controller 50 may activate a variable capacity compressor in the medium temperature compressor rack 16 at a low capacity. The system controller 50 then proceeds to 510. At 506, when there is at least one compressor 17, 18, 19 in the medium temperature compressor rack 16 that is already activated, the system controller 50 proceeds to 510.

At 510, the system controller 50 activates a compressor 13, 14 in the low temperature compressor rack 12. The control algorithm 500 ends at 512.

Figure 6:
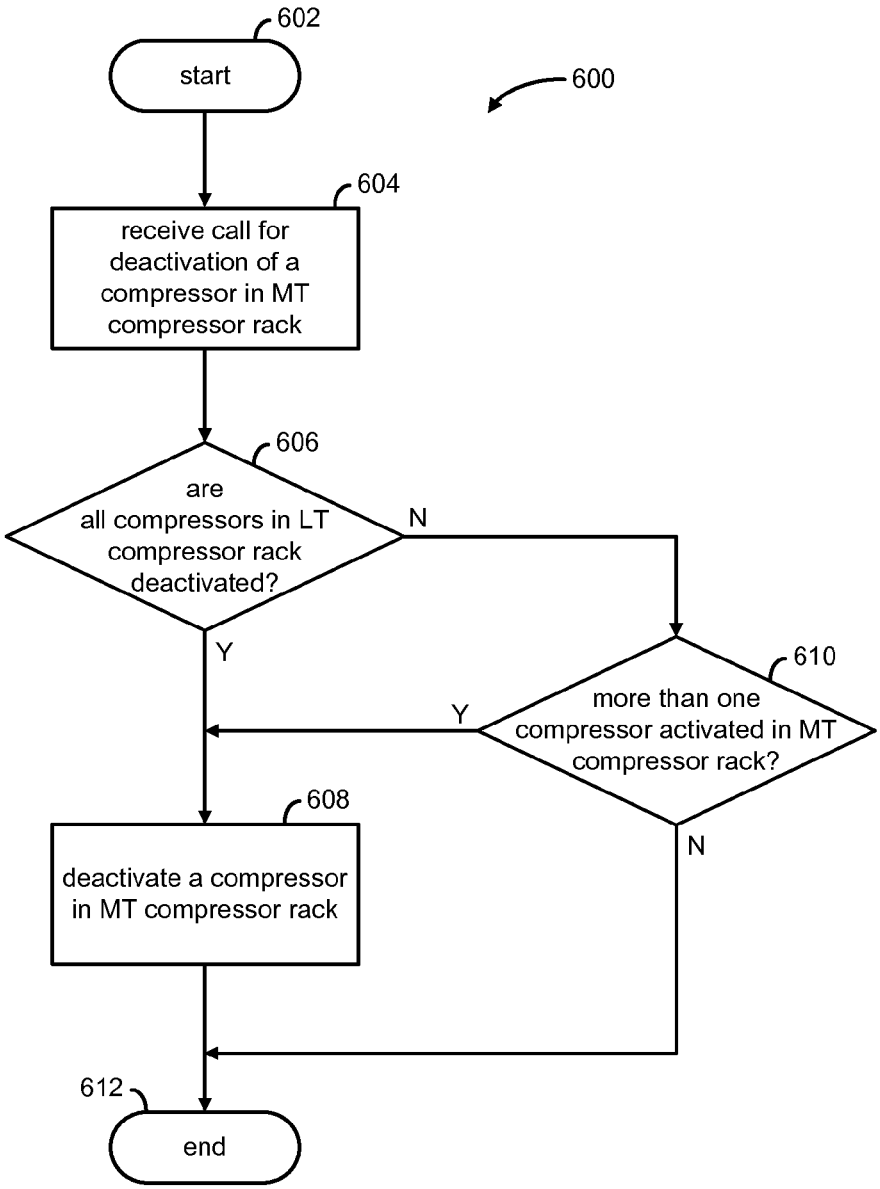
FIG. 6 is a flowchart for a control algorithm for a $CO_2$ refrigeration system.

With reference to FIG. 6, a control algorithm 600 is shown for coordinating deactivation of compressors in the medium temperature compressor rack 16 and the low temperature compressor rack 12. Because of the in-series manner of connection between the low temperature compressor rack 12 and the medium temperature compressor rack 16, all of the compressors 17, 18, 19 in the medium temperature compressor rack 16 cannot be deactivated if a compressor 13, 14 in the low temperature compressor rack 12 remains activated. The control algorithm 600 is performed by the system controller 50. The control algorithm 600 starts at 602.

At 604, the system controller 50 receives or generates a call for deactivation of a compressor in the medium temperature compressor rack 16. For example, the call for deactivation of a compressor in the medium temperature compressor rack 16 may be received or generated when reduced cooling capacity is needed for the medium temperature evaporators 26. For example, the case controller 80 for the medium temperature evaporators 26 may monitor the temperature of a refrigerated space, such as the interior of a frozen food case, and determine that less cooling capacity is needed when the temperature is below a predetermined setpoint. At 606, the system controller 50 determines whether all of the compressors 13, 14 in the low temperature compressor rack 12 are deactivated. At 606, when all of the compressor 13, 14 in the low temperature compressor rack 12 are deactivated, the system controller proceeds to 608 and deactivates a compressor 17, 18, 19 in the medium temperature compressor rack 16. At 606, when all of the compressors 13, 14 in the low temperature compressor rack 12 are not deactivated—in other words at least one compressor 13, 14 in the low temperature compressor rack 12 is activated—the system controller 50 proceeds to 610 and determines whether more than one compressor 17, 18, 19 is currently activated in the medium temperature compressor rack 16. At 610, when more than one compressor 17, 18, 19 is activated in the medium temperature compressor rack 16, the system controller 50 proceeds to 608 and deactivates a compressor 17, 18, 19 in the medium temperature compressor rack 16. At 610, when there is not more than one compressor 17, 18, 19 activated in the medium temperature compressor rack 16, the system controller 50 proceeds to 612. At 612, the control algorithm 600 ends. In this way, the system controller 50 will not deactivate the last activated compressor 17, 18, 19 in the medium temperature compressor rack 16 when there are activated compressors 13, 14 operating in the low temperature compressor rack 12. As such, the system controller 50 prevents a situation where a compressor 13, 14 in the low temperature compressor rack 12 is activated while no compressor 17, 18, 19 in the medium temperature compressor rack 16 are activated.

Likewise, compressor diagnostic information can be used for system safety functions, such as initiating a compressor rack shutdown sequence. For example, the system controller 50 may deactivate the compressors 13, 14 in the low temperature compressor rack 12 before deactivating the last compressor 17, 18, 19 in the medium temperature compressor rack 16. In this way, the system controller 50 may insure an orderly shutdown of the system without allowing the system to undergo undesirable system conditions, such as excessive system pressures or temperatures.

In the event one of the temperature or pressure sensors 62, 64, 66, 68 fails, the valve controller 60 and/or the system controller 50 may be programmed with appropriate backup control algorithms to operate the refrigeration system 10 until the faulty sensor can be repaired.

Specifically, in the event a failure occurs with temperature sensor 62 or pressure sensor 64, which sense the temperature and pressure of refrigerant exiting the gas cooler/condenser 20, respectively, the valve controller 60 may query the system controller 50 and/or the BAS 95 to determine whether either can provide backup temperature or pressure data for use by the valve controller 60. If no other backup temperature or pressure data is available, the valve controller 60 may set the HPV to a predetermined fixed opening based on whether the refrigeration system 10 is in the subcritical or the transcritical operation mode. For example, in the event of sensor failure the valve controller 60 may set the HPV 30 to operate at 50% open and/or the BGV 40 to operate at 100% open. The failure mode settings for the HPV 30 and BGV 40 may be user configurable. Further, the HPV 30 and BGV 40 may have different failure mode settings for operation in either the subcritical or transcritical operation modes.

As discussed above, the system controller 50 communicates with the valve controller 60 and the case controllers 70, 80. The system controller 50, the remote computer 90, and/or the BAS 95 may provide remote setpoint adjustment and advisory and supervisory functions to the various system controllers, including the valve controller 60. For example, the system controller 50 can monitor operation of the refrigeration system 10 and the valve controller 60 and can make setpoint adjustments, or other control strategy adjustments, on the fly. Additionally, a remote user can login to the remote computer 90 or the BAS 95 and make setpoint or other control strategy adjustments to the system controller 50 and/or the valve controller 60.

Further, the system controller 50 may receive compressor specific diagnostic data from local compressor controllers attached to one or more of the compressors 13, 14, 17, 18, 19, and may utilize that diagnostic data to modify or adjust system setpoints or control strategies, including specific setpoints utilized by the valve controller 60. For example, if a specific compressor is malfunctioning, overheating, or otherwise undergoing operational difficulties, the system controller 50 may modify setpoints or control strategies of the refrigeration system 10, including the valve controller 60, to adjust and account for the malfunctioning compressor until remedial measures can be taken.

Additionally, compressor diagnostic information can also be used to optimize the system control algorithms. For example, system controller 50 may monitor operating performance of the compressors 13, 14, 17, 18, 19 and the compressor diagnostic information. Based on the monitored performance data and/or the compressor diagnostic information, system controller 50 may appropriately select compressors that will operate most efficiently under a given set of operating conditions.

Additionally, a remote user at the remote computer 90 may assist a local technician, repairman, or installer in setting up or repairing the refrigeration system 10. In particular, $CO_2$ refrigeration systems can be difficult to install, setup, or repair, due to the unique operational aspects of the system, as described above. A local installer, who may not have particular expertise in installing, maintaining, or repairing $CO_2$ refrigeration systems can be assisted by an expert located remotely at the remote computer 90. The remote expert can then monitor and review system parameters and data and assist and instruct the local installer or technician in performing any installation, maintenance, or repair tasks.

Additionally, the case controllers 70, 80, may control the expansion valves 42, 44 based on monitored superheat of the associated low temperature evaporators 24 and medium temperature evaporators 26. The case controllers 70, 80 may be configured with auto-adaptive learning algorithms to optimize operation of the control of the associated expansion valves 42, 44. For example, a normal PI or PID control includes certain gain constants that must be appropriately tuned in order to arrive at the most desirable control behavior. With an auto-adaptive learning algorithm, the case controllers can incrementally modify associated gain constants and monitor resulting effects of such modifications. In this way, the auto-adaptive algorithm can perform tuning of the constants by monitoring these cause and effect relationships, without the need for an external technician to tune those gain constants.

Additionally, the system controller 50 may coordinate refrigeration system operations, such as defrost, across the system components. In other words, the system controller 50 can coordinate with the case controllers 70, 80 with operation of the low temperature compressor rack 12 and the medium temperature rack in the $CO_2$ refrigeration system 10 to coordinate those defrost and normal operation phases.

Additionally, the refrigeration system 10 may include additional temperature and pressure sensors in each different branch or pressure zone shown in FIG. 1. The system controller 50 can receive all such temperature and pressure data and then take appropriate remedial actions, by opening or closing the various valves, including the HPV 30 and BGV 40, as well as the expansion valves 42, 44, and any other system valves, to insure that the various system components are not subjected to any extreme, dangerous, or unsafe temperatures or pressures.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

For purposes of clarity, the same reference numbers are used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently), as appropriate, without altering the principles of the present disclosure.

As used herein, the term module may refer to, be part of, or include: an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first stage, element, component, region, layer or section discussed below could be termed a second stage, element, component, region, layer or section without departing from the teachings of the example embodiments.

What is claimed is:

1. A $CO_2$ refrigeration system, operable in a subcritical mode and a transcritical mode, comprising:

at least one compressor;

a heat exchanger that receives refrigerant discharged from the at least one compressor and that is operable as a gas cooler when the $CO_2$ refrigeration system is operating in the transcritical mode and as a condenser when the $CO_2$ refrigeration system is operating in the subcritical mode;

a liquid receiver that receives refrigerant discharged from the heat exchanger;

a first valve connected between the heat exchanger and the liquid receiver, the first valve controlling a flow of the refrigerant from the heat exchanger to the liquid receiver;

a valve controller that monitors an outdoor ambient temperature, a temperature of the refrigerant exiting the heat exchanger, and a pressure of the refrigerant exiting the heat exchanger, and determines whether the $CO_2$ refrigeration system is operating in the subcritical mode or in the transcritical mode;

wherein, when the valve controller determines that the $CO_2$ refrigeration system is operating in the transcritical mode, the valve controller determines a pressure setpoint based on the monitored outdoor ambient temperature and controls the first valve based on a comparison of the determined pressure setpoint and the monitored pressure of the refrigerant exiting the heat exchanger; and wherein, when the valve controller determines that the $CO_2$ refrigeration system is operating in the subcritical mode, the valve controller determines a subcooling temperature of the refrigerant based on the monitored temperature of the refrigerant exiting the heat exchanger and the monitored pressure of the refrigerant exiting the heat exchanger and controls the first valve based on a comparison of the calculated subcooling temperature with a predetermined subcooling setpoint.

2. The system of claim 1, wherein the valve controller determines whether the $CO_2$ refrigeration system is operating in the subcritical mode or in the transcritical mode based on the monitored outdoor ambient temperature.

3. The system of claim 1, further comprising a second valve located in a bypass line that routes refrigerant from the liquid receiver to a suction side of the at least one compressor, the second valve controlling a flow of the refrigerant from the liquid receiver to the suction side of the at least one compressor, wherein the valve controller controls the second valve based on a comparison of a monitored pressure of refrigerant within the liquid receiver and a predetermined pressure setpoint.

4. The system of claim 1, further comprising a second valve located in a bypass line that routes refrigerant from the liquid receiver to a suction side of the at least one compressor, the second valve controlling a flow of the refrigerant from the liquid receiver to the suction side of the at least one compressor, wherein the valve controller compares a monitored pressure of refrigerant within the liquid receiver with a low pressure setpoint and a high pressure setpoint and controls the first valve and the second valve in a safety mode when the monitored pressure of the refrigerant within the liquid receiver is above the high pressure setpoint or below the low pressure setpoint.

5. The system of claim 4, wherein, when the pressure of the refrigerant within the liquid receiver is below the low pressure setpoint, the valve controller increases an opening of the first valve and decreases an opening of the second valve, and when the monitored pressure of the refrigerant within the liquid receiver is above the high pressure setpoint, the valve controller decreases the opening of the first valve and increases the opening of the second valve.

6. The $CO_2$ refrigeration system recited by claim 1, wherein the valve controller determines the pressure setpoint based on a lookup table that includes a plurality of ambient temperature values with corresponding pressure setpoint values.

7. The system of claim 6, further comprising a compressor controller associated with each compressor of the at least one compressor that stores compressor identification information including at least one of a compressor model, type, size, or capacity for each compressor of the at least one compressor, wherein the valve controller stores the lookup table selected from a plurality of lookup tables based on the compressor identification information.

8. The system of claim 7 wherein the valve controller selects the lookup table from the plurality of lookup tables based on the compressor identification information.

9. The system of claim 7 wherein a separate controller selects the lookup table from the plurality of lookup tables based on the compressor identification information and communicates the selected lookup table to the valve controller.

10. A method for a $CO_2$ refrigeration system operable in a subcritical mode and a transcritical mode, the method comprising:

monitoring, with a valve controller, an outdoor ambient temperature;

monitoring, with the valve controller, a pressure and a temperature of refrigerant exiting a heat exchanger of the $CO_2$ refrigeration system, the heat exchanger receiving refrigerant discharged from at least one compressor and being operable as a gas cooler when the $CO_2$ refrigeration system is operating in the transcritical mode and as a condenser when the $CO_2$ refrigeration system is operating in the subcritical mode, the first valve being connected between the heat exchanger and a liquid receiver and controlling a flow of the refrigerant from the heat exchanger to the liquid receiver;

determining, with the valve controller, whether the $CO_2$ refrigeration system is operating in the subcritical mode or in the transcritical mode;

determining, with the valve controller, a pressure setpoint based on the monitored outdoor ambient temperature when the valve controller determines that the $CO_2$ refrigeration system is operating in the transcritical mode;

controlling, with the valve controller, a first valve based on a comparison of the determined pressure setpoint and the monitored pressure of the refrigerant exiting the heat exchanger when the valve controller determines that the $CO_2$ refrigeration system is operating in the transcritical mode;

determining, with the valve controller, a subcooling temperature of the refrigerant based on the monitored pressure and temperature of the refrigerant exiting the heat exchanger when the valve controller determines that the $CO_2$ refrigeration system is operating in the subcritical mode; and controlling, with the valve controller, the first valve based on a comparison of the calculated subcooling temperature with a predetermined subcooling when the valve controller determines that the $CO_2$ refrigeration system is operating in the subcritical mode.

11. The method of claim 10, wherein the determining whether the $CO_2$ refrigeration system is operating in the subcritical mode or in the transcritical mode is based on the monitored outdoor ambient temperature.

12. The method of claim 10, the $CO_2$ refrigeration system including a second valve that controls a flow of refrigerant in a bypass line that routes refrigerant from the liquid receiver to a suction side of the at least one compressor, the method further comprising:

controlling, with the valve controller, the second valve based on a comparison of a monitored pressure of refrigerant within the liquid receiver and a predetermined pressure setpoint.

13. The method of claim 10, the $CO_2$ refrigeration system including a second valve that controls a flow of refrigerant in a bypass line that routes refrigerant from the liquid receiver to a suction side of the at least one compressor, the method further comprising:

comparing, with the valve controller, a monitored pressure of refrigerant within the liquid receiver with a low pressure setpoint and a high pressure setpoint; and controlling, with the valve controller, the first valve and the second valve in a safety mode when the monitored pressure of the refrigerant within the liquid receiver is above the high pressure setpoint or below the low pressure setpoint.

14. The method of claim 13, wherein the controlling the first valve and the second valve in the safety mode includes:

increasing an opening of the first valve and decreasing an opening of the second valve when the pressure of the refrigerant within the liquid receiver is below the low pressure setpoint; and decreasing the opening of the first valve and increasing the opening of the second valve when the monitored pressure of the refrigerant within the liquid receiver is above the high pressure setpoint.

15. The method of claim 10, wherein the pressure setpoint is determined by the valve controller based on a lookup table that includes a plurality of ambient temperature ambient temperature values with corresponding pressure setpoint values.

16. The method of claim 15, the $CO_2$ refrigeration system including a compressor controller associated with each compressor of the at least one compressor that stores compressor identification information including at least one of a compressor model, type, size, or capacity for each compressor of the at least one compressor, the method further comprising:

storing, with the valve controller, the lookup table selected from a plurality of lookup tables based on the compressor identification information.

17. The method of claim 16 further comprising:

selecting, with the valve controller, the lookup table from the plurality of lookup tables based on the compressor identification information.

18. The method of claim 16 further comprising:

selecting, with a separate controller, the lookup table from the plurality of lookup tables based on the compressor identification information;

communicating, with the separate controller, the selected lookup table to the valve controller.

* * * * *